US010711558B2

(12) United States Patent
Leuchtenberg et al.

(10) Patent No.: US 10,711,558 B2
(45) Date of Patent: Jul. 14, 2020

(54) PRESSURE CONTAINMENT DEVICE

(71) Applicant: MANAGED PRESSURE OPERATIONS PTE. LTD., Singapore (SG)

(72) Inventors: Christian Leuchtenberg, Singapore (SG); George Michaud, Calgary (CA)

(73) Assignee: MANAGED PRESSURE OPERATIONS PTE. LTD, Singapore (SG)

( * ) Notice: Subject to any disclaimer, the term of this patent is extended or adjusted under 35 U.S.C. 154(b) by 106 days.

(21) Appl. No.: 16/021,021

(22) Filed: Jun. 28, 2018

(65) Prior Publication Data

US 2018/0334877 A1 Nov. 22, 2018

Related U.S. Application Data

(63) Continuation of application No. 14/542,776, filed on Nov. 17, 2014, now Pat. No. 10,036,227.

(30) Foreign Application Priority Data

Nov. 22, 2013 (GB) ..... 1320695.8

(51) Int. Cl.

| | |
|---|---|
| ***E21B 33/08*** | (2006.01) |
| ***E21B 33/06*** | (2006.01) |
| ***E21B 34/08*** | (2006.01) |
| ***E21B 34/00*** | (2006.01) |
| ***E21B 34/10*** | (2006.01) |

(52) U.S. Cl.

CPC ..... *E21B 33/085* (2013.01); *E21B 33/06* (2013.01); *E21B 33/08* (2013.01); *E21B 34/08* (2013.01); *E21B 34/00* (2013.01); *E21B 34/108* (2013.01)

(58) Field of Classification Search

CPC ..... E21B 33/06; E21B 33/08; E21B 33/085; E21B 34/00; E21B 34/08

See application file for complete search history.

(56) References Cited

U.S. PATENT DOCUMENTS

| | | | |
|---|---|---|---|
| 2,148,844 | A | 2/1939 | Stone et al. |
| 2,158,366 | A | 5/1939 | Dyer |

(Continued)

FOREIGN PATENT DOCUMENTS

| | | | |
|---|---|---|---|
| EP | 1830034 | A2 | 9/2007 |
| WO | WO 03/042485 | A2 | 5/2003 |

(Continued)

*Primary Examiner* — Nicole Coy

(74) *Attorney, Agent, or Firm* — Norman B. Thot

(57) ABSTRACT

In an embodiment, the present invention provides a pressure containment device which includes a housing with a returns outlet port, an injection port, and an overflow outlet port, and a seal assembly with a seal arranged in the housing to surround and enter into a sealing engagement with a tubular body extending along a passage in the housing via a sealing face. The injection port is arranged between the returns outlet port and a first end of the seal. The overflow outlet port is arranged adjacent to a second, opposite, end of the seal and communicates with an upper end of the passage. The upper end of the passage connects to a bell nipple or to a section of a riser pipe and, in use, the overflow outlet port is exposed to a hydrostatic head provided by a fluid in the bell nipple or the section of the riser pipe.

20 Claims, 5 Drawing Sheets

(56) References Cited

U.S. PATENT DOCUMENTS

| | | | | |
|---|---|---|---|---|
| 2,731,281 | A | 1/1956 | Knox | |
| 6,129,152 | A | 10/2000 | Hosie et al. | |
| 7,040,394 | B2 | 5/2006 | Bailey et al. | |
| 7,380,590 | B2 | 6/2008 | Hughes et al. | |
| 7,699,109 | B2 | 4/2010 | May et al. | |
| 7,926,560 | B2 | 4/2011 | Bailey et al. | |
| 2003/0089506 | A1 | 5/2003 | Ayler et al. | |
| 2011/0024195 | A1* | 2/2011 | Hoyer | E21B 33/085 175/65 |
| 2013/0118749 | A1 | 5/2013 | Hannegan et al. | |

FOREIGN PATENT DOCUMENTS

| | | | |
|---|---|---|---|
| WO | WO 2011/128690 | A1 | 10/2011 |
| WO | WO 2012/127227 | A2 | 9/2012 |

* cited by examiner

PRESSURE CONTAINMENT DEVICE

CROSS REFERENCE TO PRIOR APPLICATIONS

This application is a continuation of application Ser. No. 14/542,776, filed on Nov. 17, 2014, which claims benefit to Great Britain Patent Application No. 1320695.8, filed on Nov. 22, 2013.

FIELD

The present invention relates to a pressure containment device for use in a drilling system, and a method of operating such a device.

BACKGROUND OF THE INVENTION

Subterranean drilling typically involves rotating a drill bit from surface or on a downhole motor at the remote end of a tubular drill string. It involves pumping a drilling fluid down the inside of the tubular drillstring, through the drill bit, and circulating this fluid continuously back to surface via the drilled space between the hole/tubular, referred to as the annulus. This pumping mechanism is provided by positive displacement pumps that are connected to a manifold which connects to the drillstring, and the rate of flow into the drillstring depends on the speed of these pumps. The drillstring is comprised of sections of tubular joints connected end to end, and their respective outside diameter depends on the geometry of the hole being drilled and their effect on the fluid hydraulics in the wellbore. The drillstring ends are connected by a thicker material larger diameter section of the joint located at both ends of the section called tool joints.

Tool joints provide high-strength, high pressure threaded connections that are sufficiently robust to survive the rigors of drilling and numerous cycles of tightening and loosening at the drillpipe connections. The large diameter section of the tool joints provides a low stress area where rig pipe tongs are used to grip the pipe to either make up or break apart the connection of two separate sections of drillpipe.

For a subsea well bore, a tubular, known as a riser extends from the rig to a well head at the top of the wellbore subsea on the ocean floor. It provides a continuous pathway for the drill string and the fluids emanating from the well bore. In effect, the riser extends the wellbore from the sea bed to the rig, and the annulus also comprises the annular space between the outer diameter of the drill string and the riser.

The bit penetrates its way through layers of underground formations until it reaches target prospects—rocks which contain hydrocarbons at a given temperature and pressure. These hydrocarbons are contained within the pore space of the rock i.e. the void space and can contain water, oil, and gas constituents—referred to as reservoirs. Due to overburden forces from layers of rock above, these reservoir fluids are contained and trapped within the pore space at a known or unknown pressure, referred to as pore pressure. An unplanned inflow of these reservoir fluids is well known in the art, and is referred to as a formation influx or kick and commonly called a well control incident or event.

The purpose of the drilling fluid (also known as mud) is to lubricate, carry drilled rock cuttings to surface, cool the drill bit, and power the downhole motor and other tools. Mud is a very broad term and in this context it is used to describe any fluid or fluid mixture that covers a broad spectrum from air, nitrogen, misted fluids in air or nitrogen, foamed fluids with air or nitrogen, aerated or nitrified fluids, to heavily weighted mixtures of oil and water with solids particles. Most importantly this fluid and its resulting hydrostatic pressure—the pressure that it exerts at the bottom of the well bore (known as the bottom hole pressure or BHP) from its given density and total vertical height/depth—prevent the reservoir fluids at their existing pore pressure from entering the drilled annulus. The drilling fluid must also exert a pressure less than the fracture pressure of the formation, otherwise fluid will be forced into the rock as a result of pressure in the wellbore exceeding the formation's horizontal stress forces.

The BHP exerted by the hydrostatic pressure of the drilling fluid is the primary barrier for preventing influx from the formation. BHP can be expressed in terms of static BHP or dynamic/circulating BHP. Static BHP relates to the BHP value when the mud pumps are not in operation. Dynamic or circulating BHP refers to the BHP value when the pumps are in operation during drilling or circulating.

The use of blow out preventers, referred to as BOP's, are used to seal and control the formation influxes, described herein, in the wellbore are well known in the art—these are compulsory pressure safety equipment used on both land and off-shore rigs. Whilst land and subsea BOPs are generally secured to the well head at the top of a wellbore, BOPs on off-shore rigs are generally mounted subsea and below the rig deck and integrated into the riser system and positioned on the ocean floor. These are well known in the art.

The annular BOP elements seal around the drill string, thus closing the annulus and stopping flow of fluid from the wellbore. They typically include a large flexible rubber or elastomer packing unit configured to seal around a variety of drillstring sizes when activated, and are not designed to be actuated during drillstring rotation as this would rapidly wear out the sealing element. A pressurized hydraulic fluid and piston assembly are used to provide the necessary closing pressure of the sealing element. With wellbore pressure below the closed element some fluid may invade the sealing face from below and assist in lubricating the pipe as it is moved through the element—but this is not a controlled process. With these conditions, when a continuous leak rate occurs through a BOP it generally indicates a loss of integrity. These are well known in the art.

Managed Pressure Drilling (MPD) and/or Underbalanced Drilling (UBD) utilizes additional special equipment that has been developed to keep the well closed at all times, as the wellhead pressures in these cases are above atmospheric pressure, unlike in conventional overbalanced drilling. MPD generally allows drilling with a pressurized annulus while preventing co-mingled and/or produced formation fluids hydrocarbons from entering the wellbore and reaching surface, resulting in a pressurized annulus of a single density drilling fluid. UBD allows the flow of comingled drilling and reservoir fluids to surface during drilling and therefore contains a pressurized annulus containing hydrocarbons and drilling fluid which may be multi-phase.

Equivalent circulating density—ECD is the increase in the BHP expressed as an increase in pressure that occurs only when drilling fluid is being circulated. The ECD value reflects the total friction losses over the entire length of the wellbore annulus, from the point of fluid exiting the drilling bit at the wellbore bottom to where it exits the well at the surface just below the rig floor of the floating installation. The ECD can result in a bottom hole pressure during circulating/drilling that varies from slightly to significantly higher values when compared to static conditions i.e. no circulation. Therefore the goal of a conventional drilling system is to maintain the BHP above the pore pressure but below the fracture pressure while taking the ECD into account to manage the BHP. The management of BHP through MPD allows the BHP to be controlled and maintained as constant as possible within a narrow window using a combination of a lighter drilling fluid and applied choke pressure at surface.

During MPD and/or UBD, the closed loop is generated by a pressure seal around the drillpipe at surface with a rotating pressure containment device—RPC, and flow is diverted to a flow line below the sealing point of this device. These sealing devices can also be referred to as a Rotating Control Device—RCD or Rotating Control head—RCH, Rotating Blowout Preventer—RBOP, or Pressure Control While Drilling—PCWD. The function of the RPC device is to allow the drill string and its tool joints to pass through while reciprocating/stripping or rotating while maintaining pressure integrity such that the annulus isolated from the external atmosphere. All the aforementioned devices use a stationary seal that does not rotate relative to the drill pipe and the rotation is handled by a bearing which may be a thrust, roller, cone or ball bearing(s) or a combination of these.

Stripping is the vertical movement of drill pipe through any sealing device with wellbore pressure present below the sealing point. As both the frequency of larger diameter tool joints passing through the element and the velocity of the pipe movement increase during stripping, this is generally when most sealing devices tend to fail. These two main factors in combination with temperature and wellbore fluid composition result in the operational longevity of the sealing device to be affected.

A typical RPC device includes an elastomer or rubber packing/sealing element and a bearing assembly that allows the sealing element to rotate along with the drill string. There is no rotational movement between the drill string and the sealing element—only the bearing assembly exhibits the rotational movement during drilling. These are well known in the art and are described in detail in U.S. Pat. Nos. 7,699,109, 7,926,560, and 6,129,152.

The pressure seal provided by conventional RPC designs is achieved using active and/or passive methods.

Passive sealing is accomplished by the exertion from the wellbore pressure below against the lower part of the sealing element exposed to the annulus which forces the element inwards against the drill pipe external surface. Passive seals are well known in the art and are described in U.S. Pat. No. 7,040,394.

Active seals are usually provided by the use of a hydraulics network system, circuitry, and bladder. A hydraulic circuit provides fluid to the RPC device and a high pressure hydraulic pump within the circuit is used to energize the active seal arrangement. The pressure chamber for activating the bladder is preferably defined within the rotating seal assembly, and the rotating seal assembly includes both the bladder and the bearings. The rotating seal assembly is hydraulically secured within the RPC device housing, usually by remote control and performed by a single cylindrical latch piston. Active seals are well known in the art, and disclosed, for example, in U.S. Pat. Nos. 7,380,590 and 7,040,394.

Current systems and methods associated with these prior art pressure containment devices allow for a controlled lubrication across their active or passive sealing mechanism that consists of a lubrication fluid, usually oil. The oil is contained under pressure within the bearings by the use of special seals that allow for the isolation of the pressurized bearing from the wellbore fluids. Any leak of wellbore fluids across these seals will result in failure of the seals due to the abrasive action of the mud containing drill cuttings and subsequent rapid failure of the bearings or bearing assembly.

During times of circulating and non-circulating it is critical that the BHP at the bottom of the hole where the reservoir exists is always greater than the reservoir pressure. During connections, where additional pipe must be added, the BHP must be maintained during periods of no circulation through the drilling bit. During MPD and in the absence of continuous circulation methods as disclosed in U.S. Pat. No. 2,158,356, an external high volume pump is used to inject fluid into the riser at a point below the RPC device. This injected fluid circulates through to the main returns flow line at surface and through the choke valve, such that a combination of the choke position and/or injected flow rate can be used to maintain the BHP constant during connections.

There are inherent problems related to the design of current RPC technology. It is difficult to monitor the wear or integrity of the sealing element in question when it is in service, and depending on the axial and radial loads and bending moments present from drilling the internal sealing face between the drillpipe and sealing element starts to wear. Furthermore, bearing assemblies and internal seals under excessive drilling loads start to mechanically fail. However, with dual sealing arrangements differential pressure across the lower sealing element may be monitored in the cavity between the upper and lower sealing elements to determine if the wellbore pressure is passing the lower seal. Such a system is described in US 2013/0118749. Additionally, with these designs there are no lubricating fluids injected or pumped across the sealing faces to reduce the friction and heat generated from pipe movement through the seal during stripping or drilling.

The loads imposed on the sealing elements of any RPC device increase as larger diameter tool joints pass through the sealing assembly, resulting in a higher degree of deformation and imposing higher axial and compressive loads on the sealing elements. During stripping operations, where excessive lengths of drill pipe are reciprocated in or out of the well with wellbore pressure present below the RPC device, multiple tool joints pass through the sealing element causing it to wear and permanently deform over time.

The degree of deformation and wear depends on the magnitude of the wellbore pressure, temperature, fluid composition, and upward/downward velocity of the pipe through the element. The higher the wellbore pressure, the higher the differential pressure is created across the sealing face. Higher temperatures and different fluid compositions further degrade the sealing element, affecting its performance and causing further breakdown. Furthermore, as the sealing elements deform, solids from the wellbore invade the sealing face which increases the wear rate. Without a lubricating fluid the wear rates on typical RPC designs can be excessive, and without the ability to accurately monitor the integrity of the sealing element in question the sealing elements tend to suddenly fail before they can be replaced. This can result in the uncontrolled release of fluid and/or gas pressure at the rig floor and to the surrounding atmosphere.

Additionally, the frictional coefficients present with elastomeric materials used in current RPC sealing element designs are too high and greatly affect their operational life. This, compounded with the problems described herein, impacts the effectiveness of their sealing capacity.

A new design approach to pressure containment technology was described in previously filed patent applications WO2012/127227 and WO2011/128690.

The system design and methods disclosed in these applications includes a tubular elastomeric or polymeric stripping sleeve inserted and concentrically positioned across an annular packing unit. As the packer closes, the radial pressure of the packer on the external surface of the sleeve forces it radially inwards against the tubular, thus providing a non-rotating seal for drillpipe rotation i.e. the drillpipe rotates within the stationary sleeve. This system uses no conventional bearings, and the radial friction created from the annular packer against the external surface of the sleeve prevents the sleeve from rotating with the drill pipe. The stripping sleeve sustains the integrity of the annular packer and becomes the wearable, disposable item.

In a stacked dual configuration i.e. two sleeves and two annular packers spaced a specific distance apart, the wellbore pressure can be staged down across each sealing face to reduce the overall pressure drop and further enhance longevity. The dual assembly allows the staging of larger diameter tool joints if spaced adequately apart, eliminating the larger tool joint diameter from being forced upwards or downwards into the closed sleeve. This would further enhance its longevity as the sleeve would not be exposed to the additional loads imposed by the tool joint body.

A set of upper and lower locking dogs/pistons contained within the annular packer housing allow the landing and securing of either a single or dual sleeve arrangement. These extend radially inwards into the central bore of the housing and prevent longitudinal movement of the stripping sleeve.

In the dual arrangement, fluid is injected between the two energized sleeves and maintained at a specified pressure determined by the wellbore pressure present. The fluid is returned through a return line opposite the injection line, equipped with a choke such that pressure between the sleeves can be controlled. Maintaining this pressure within the cavity decreases the pressure drop across the lower sleeve and enhances the sleeve's longevity as a result. Furthermore, the opposing fluid rates from the return and injection lines can be compared to determine the integrity of the sleeves—i.e. if fluid is either passing through the upper or lower sleeve or if wellbore fluid is entering passing through the lower sleeve. Supplying a lubricating fluid to this cavity may assist in lubricating the drill string as it enters this region and thus ultimately reducing the frictional forces between the sealing faces of the sleeve and the drill pipe. The lubrication fluid does not have to be a special lubricant or oil as for the bearing type systems mentioned earlier. It is sufficient for this to consist of 'clean' drilling fluid i.e. drilling fluid which has had the cuttings removed. Such fluid is in ample supply from the active drilling tank which is the same supply as is pumped down the drill pipe.

This design may also provide a floating fluid seal or hydrodynamic film between the seal sleeve and the drill string that will assist in actively sealing around the tubular, using lubricants such as drilling fluid or hydraulic oil. This may assist in decreasing friction and associated wear rates as the drill pipe is rotated and reciprocated through the energized sleeve.

SUMMARY

In an embodiment, the present invention provides a pressure containment device for containing pressure in an annulus around a tubular body. The pressure containment device includes a housing and a sealing assembly. The housing comprises a housing axis, a passage extending generally parallel to the housing axis, a returns outlet port, an injection port, and an overflow outlet port. Each of the returns outlet port, the injection port, and the overflow outlet port extend through the housing from an exterior of the housing into the passage. The tubular body passes through the housing so that a portion of the tubular body extends along the passage in the housing. The seal assembly comprises a seal arranged in the housing to surround and enter into a sealing engagement with the tubular body extending along the passage via a sealing face. The injection port is arranged between the returns outlet port and a first end of the seal. The overflow outlet port is arranged adjacent to a second end of the seal, which is arranged opposite to the first end of the seal, so as to be separated from the injection port by the seal and is in a fluid communication with an upper end of the passage. The upper end of the passage is configured for connection to a bell nipple or to a section of a riser pipe and, in use, the overflow outlet port is exposed to a hydrostatic head provided by a fluid in the bell nipple or the section of the riser pipe.

BRIEF DESCRIPTION OF THE DRAWINGS

The present invention is described in greater detail below on the basis of embodiments and of the drawings in which.

DETAILED DESCRIPTION

Figure 1:
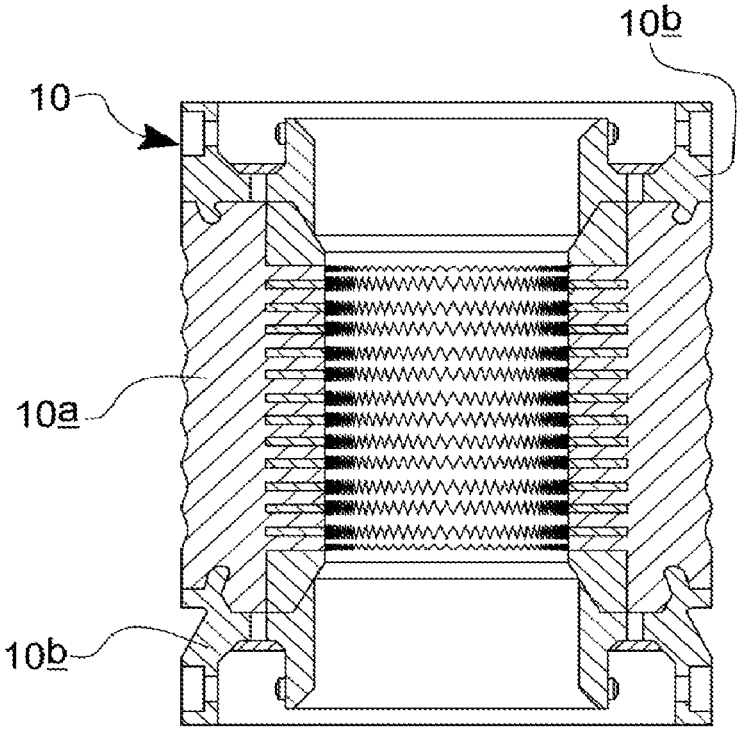
FIG. 1 is an illustration of a longitudinal cross-section through a seal sleeve suitable for use in a pressure containment device according to the present invention.

According to a first aspect of the invention we provide a pressure containment device for containing pressure in an annulus around a tubular body such as a drill string, the device comprising a housing having an axis and a passage extending generally parallel to the housing axis, and a seal assembly comprising a seal located in the housing to surround and enter into sealing engagement with a tubular body extending along the passage, wherein the housing is provided with a returns outlet port, an injection port, and an overflow outlet port, all of which extend through the housing from the exterior of the housing into the passage, the injection port being located between the returns outlet port and a first end of the seal, and the overflow outlet port being located adjacent a second, opposite end of the seal, and thus being separated from any injection port by the seal.

The seal may be a generally tubular sleeve.

The seal is preferably adapted to remain substantially stationary in the housing when in sealing engagement with a tubular body which is moving in the housing (for example when the tubular body rotates about its longitudinal axis).

The seal assembly may further comprise an actuator which is operable to urge the seal into sealing engagement with a tubular body extending along the passage in the housing.

The actuator may comprise a piston which is movable generally parallel to the housing axis. In this case, the seal assembly may further comprise an annular packer which is located between the piston and the seal so that the piston is movable against the packer to force the packer to act on the seal, to urge the seal into seal engagement with a tubular body extending along the passage in the housing. The seal may be located in the circular space enclosed by the annular packer.

The seal assembly may comprise a plurality of seals which are spaced along the housing axis.

The seal may be provided in a first housing part.

The returns outlet port may be provided in a second housing part.

The injection port may be provided in a third housing part.

The overflow port may be provided in a fourth housing part.

All these housing parts may be integral so that the housing comprises a single housing unit. Alternatively, one or more of these housing parts may be separate but secured relative to the adjacent housing part or parts. For example, the first housing part may be integral with the fourth housing part, and the second housing part may be integral with the third housing part.

The pressure containment device may further include at least one locking element which may be used to retain the seal in the housing, but which is operable to release the seal so that the seal can be removed from the housing. The locking element may comprise a locking dog which is a generally cylindrical element mounted in an aperture in the housing, and which is movable between an extended position in which is extends from the housing into the passage, and retracted position in which it does not extend into the passage at all or to such an extent.

The device may include two locking elements, or two sets of locking elements, which are spaced along the housing axis so that the seal is, in use, retained between the two locking elements or sets of locking elements.

In one embodiment, a locking element is located between the injection port and the seal.

In one embodiment, a locking element is located between the overflow port and the seal.

The injection port may comprise a plurality of injection ports which are spaced around the housing between the returns outlet port and the seal.

According to a second aspect of the invention we provide a drilling system including a pressure containment device according to the first aspect of the invention, and a pump which is connected to the injection port via an injection flow line.

The injection flow line may be provided with a flow meter is operable to measure the rate of flow of fluid along the injection flow line.

The drilling system may be further provided with a returns flow line extending from the returns outlet port.

The returns flow line may be provided which a flow meter which is operable to measure the rate of flow of fluid along the returns flow line.

The return line may be provided with a pressure control valve which is operable to restrict flow of fluid along the returns flow line to a variable degree.

The returns flow line may extend from the returns outlet port to a drilling fluid treatment system.

The drilling system may further include an overflow line which extends from the overflow outlet port.

The overflow line may be provided with a flow meter which is operable to measure the rate of flow of fluid along the overflow line.

According to a third aspect of the invention we provide a method of operating a drilling system, the drilling system including a drill string, a pressure containment device for containing pressure in an annulus around the drill string, the pressure containment device comprising a housing having an axis, a passage extending generally parallel to the housing axis, and a seal assembly comprising a seal located in the housing, the drilling string passing through the housing in such way that a portion of the drill string extends along the passage in the housing, wherein the method comprises the steps of pumping drilling fluid into the drill string and allowing the drilling fluid from the drill string to exit the annular space around the drill string via a returns outlet port provided in the housing below the lowermost end of the seal, injecting a further fluid into the passage of the housing via an injection port provided in the housing between the returns outlet port and the lowermost end of the seal, and setting the seal into sealing engagement with a portion of the drill string extending along the passage in the housing such that a proportion of the fluid injected into the passage via the injection port can leak up the passage between the drill string and the seal.

The method may further include the step of removing the fluid that has leaked up between the drill string and the seal via an overflow outlet port provided in the housing adjacent the uppermost end of the seal.

The fluid injected into the housing via the injection port may be clean drilling fluid.

The seal assembly may further include an actuator which is operable to urge the seal into engagement with the drill string. In this case, the method may include the steps of operating the actuator to vary the force with which the seal is urged into engagement with the drill string (hereinafter referred to as the sealing force) until a desired rate of leakage of injected fluid between the seal and the drill string is achieved. The method may include the steps of operating the actuator to urge the seal into engagement with the drill string with a relatively high sealing force before commencing injection of fluid into the injection port, and then, after commencing injection of fluid into the injection port, operating the actuator to decrease the sealing force until the desired rate of leakage of injected fluid between the drill string and the seal is achieved.

The method may further comprise the step of monitoring the rate of flow of fluid out of the housing via the returns outlet port (Q3).

The method may further comprise the step of monitoring the rate of flow of fluid out of the housing via the overflow outlet port (Q4). In this case, the measured rate of flow of fluid out of the housing via the overflow outlet may be used to determine if the desired rate of the desired rate of leakage of injected fluid between the drill string and the seal has been achieved.

The method may further include the step of commencing drilling once the rate of flow of fluid through the returns outlet port and the rate of flow of fluid thought the overflow outlet port are substantially constant.

The method may further include monitoring the rate of flow of fluid into the housing via the injection port (Q1).

The method may further include monitoring the rate of flow of drilling fluid into the drill string (Q5) and/or the rate of return of drilling fluid into the passage of the housing around the drill string (Q2).

The method may include commencing a well control procedure if Q3≠Q5+(Q1−Q4) whilst Q1 and Q4 are substantially constant.

The method may include using the measure values of Q1, Q3, Q4 and Q5 to determine if the seal has worn and might need replacing.

The method may include commencing a procedure to replace the seal if Q4 increases and Q3 decreases in direct proportion whilst Q1 and Q5 are substantially constant.

The method may further include the step of increasing the rate of injection of fluid into the housing via the injection port in the event of an influx of gas into the drilling fluid from a formation into which the drill string is drilling.

The drilling system may include any of the features of the drilling system according to the second aspect of the invention.

Embodiments of the present invention will now be described under reference to the accompanying drawings.

In one embodiment, the invention is used in conjunction with the type of pressure containment device described in WO2011/128690 and WO2013/127227, the contents of which are incorporated herein by reference. The major features of this type of pressure containment system will be described below with reference to FIGS. 1, 2, 3 and 4.

In one embodiment, the pressure containment device includes a seal 10, which is this embodiment is a tubular seal sleeve 10, mounted in a housing 12, the housing 12 having a passage 14 which extends along an axis of the housing (in the example the longitudinal axis of the housing 12), and along which, in use, a drill string passes.

Referring to FIG. 1, there is shown a longitudinal cross-section through an embodiment of suitable seal sleeve 10. In this embodiment, the seal sleeve 10 comprises a flexible cylindrical tubular part 10*a* which is mounted between two annular, rigid, (preferably metallic) support plates 10*b*. The flexible tubular part 10*a* is preferably a co-molded elastomeric and non-elastomeric composite, made with a honeycomb/hatched structure as described in more detail in WO2011/128690.

Figure 2:
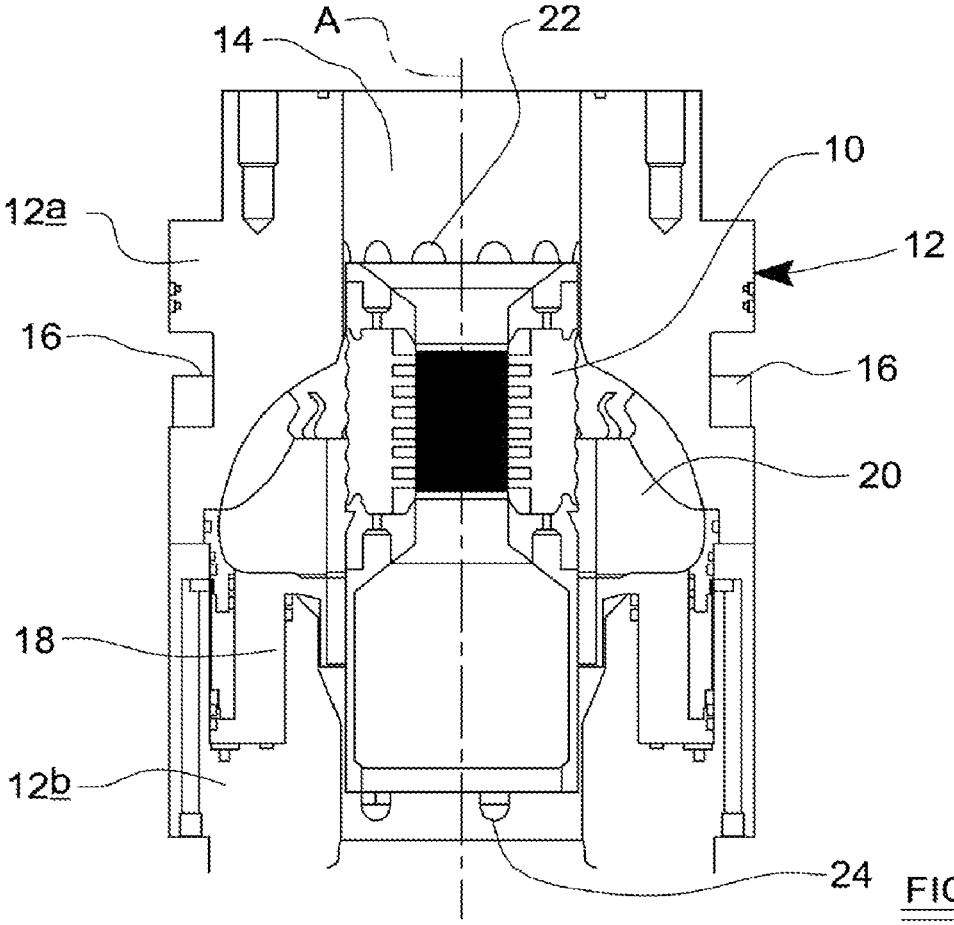
FIG. 2 is an illustration of a longitudinal cross-section through a pressure containment device according to the present invention incorporating the seal sleeve illustrated in FIG. 1.

Referring now to FIG. 2, there is shown the seal sleeve 10 mounted in the housing 12 of the pressure containment device. The housing 12 comprises upper and lower housing parts 12*a*, 12*b* which are connected by a series of studs 16 situated radially around the upper housing part 12*a*. The housing 12 encloses a longitudinal passage 14, which extends along axis A through the housing 12.

In this embodiment, the seal is an active seal, i.e. a mechanism is provided to urge the seal into engagement with a drill string passing along the longitudinal passage 14 in the housing 12. This mechanism comprises a piston 18, an elastomeric packer 20, and associated open and close chambers which may be supplied with pressurised fluid by a hydraulic control circuit (not shown). The seal sleeve 10 is positioned radially inwardly of the packer 20, so that the packer 20 surrounds the seal sleeve 10, and the seal sleeve 10 and packer 20 are both coaxially arranged about the longitudinal axis A of the housing 12. The piston 18 is movable generally parallel to the longitudinal axis A of the housing 12.

When hydraulic fluid is supplied to the close chamber, the piston 18 is pushed against the packer 20, which squashes the packer 20 against the upper part 12*a* of the housing 12. This causes the packer 20 to contract radially inwardly against the flexible sleeve 10*a* of the seal 10. This, in turn, forces the seal 10 to move radially inwardly until it contacts the drill string. In use, the seal sleeve 10 is forced into sealing engagement with the drill string, but forms a non-rotating seal, i.e. is designed to remain stationary whilst the drill string rotates during drilling.

Conversely, when pressure is released from the close chamber, and pressure supplied to the open chamber, the piston 18, packer 20 and seal 10 retract to their original positions, in which the seal 10 is spaced from the drill string.

In this embodiment, the seal sleeve 10 is retained in position surrounded by the packer 20 by means of upper and lower locking dogs 22, 24. These are movable between a retracted position in which they are contained within apertures provided in the upper and lower housing parts 12*a*, 12*b* respectively, and an extended position in which they extend radially inwardly from the housing 12 into the longitudinal passage 14. The locking dogs 22, 24 are moved from the retracted position to the extended position by the supply of hydraulic pressure to a closing chamber of the respective locking dog 22, 24, and moved from the extended position by the supply of hydraulic pressure to an opening chamber.

Figure 4:
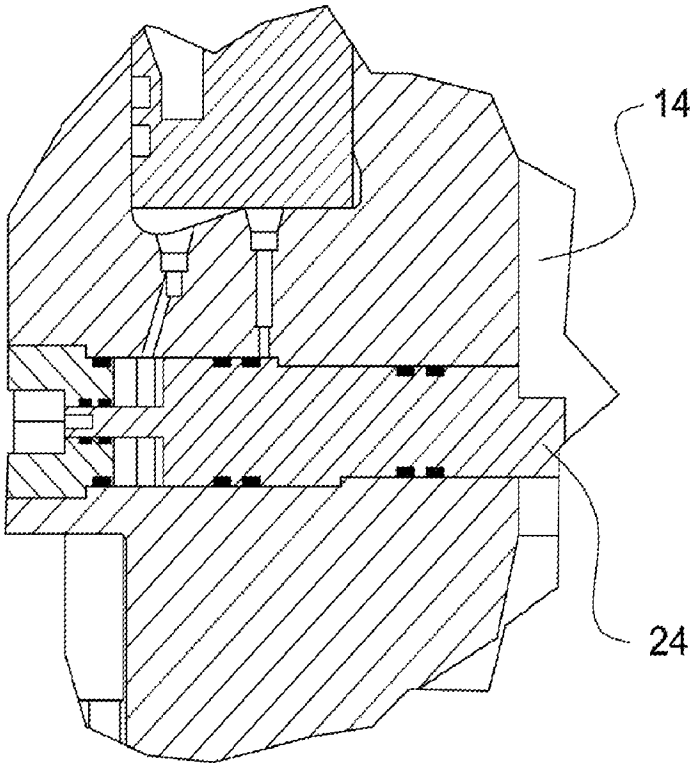
FIG. 4 is a cross-section through the part of the housing of the pressure containment device shown in FIG. 2 incorporating a lower locking dog.
Figure 3:
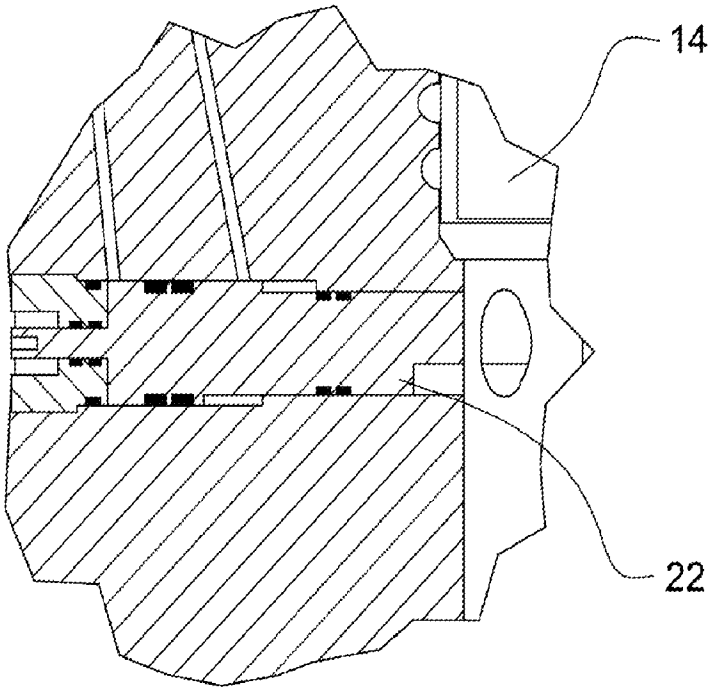
FIG. 3 is a cross-section through the part of the housing of the pressure containment device shown in FIG. 2 incorporating an upper locking dog.

Cross sections of a locking dog and the interface with the seal sleeve 10 are illustrated in FIGS. 3 & 4. FIG. 3 shows an upper locking dog 22 in the retracted position, whilst FIG. 4 shows a lower locking dog 24 in the extended position with the seal sleeve 10 landed on a landing shoulder provided by the locking dog 24.

In one embodiment, there are a plurality of lower locking dogs 24 regularly spaced in a circumferential array around the housing 12. There are also a plurality of upper locking dogs 22 spaced in a similar circumferential array around the housing 12, which is displaced along the longitudinal axis A relative to the array of lower locking dogs 24. The separation between these two arrays of locking dogs 22, 24 is slightly greater than the length of the seal sleeve 10.

The seal sleeve 10 is located in the desired position in the housing 12 by first moving the lower locking dogs 24 to extended position and the upper locking dogs 22 to the retracted position, and then lowering the seal sleeve 10 into the longitudinal passage 14 of the housing 12 until the lower support plate 10*b* of the seal sleeve 10 comes to rest on the lower locking dogs 24. The upper locking dogs 22 are then moved to the extended position so that the seal sleeve 10 is captured between the two sets of locking dogs 22, 24 and significant vertical movement of the seal sleeve 10 within the housing 12 is prevented. The locking dogs 22, 24 thus provide both a landing shoulder and sleeve support mechanism and assist securing the seal sleeve 10 within the housing 12.

When the seal sleeve 10 is not in position, the locking dogs 22, 24 are retracted into the housing 12 so that the diameter of the longitudinal passage 14 in the housing 12 is not compromised.

In use, the pressure containment device is mounted in a riser of a drilling system, with the longitudinal axis A of the housing generally parallel to the longitudinal axis of the riser, so that a drill string passing down the riser passes through the housing 12 along its longitudinal passage, and, when the seal sleeve seals against the drill string, the pressure containment device contains the fluid in the riser annulus.

Figure 5:
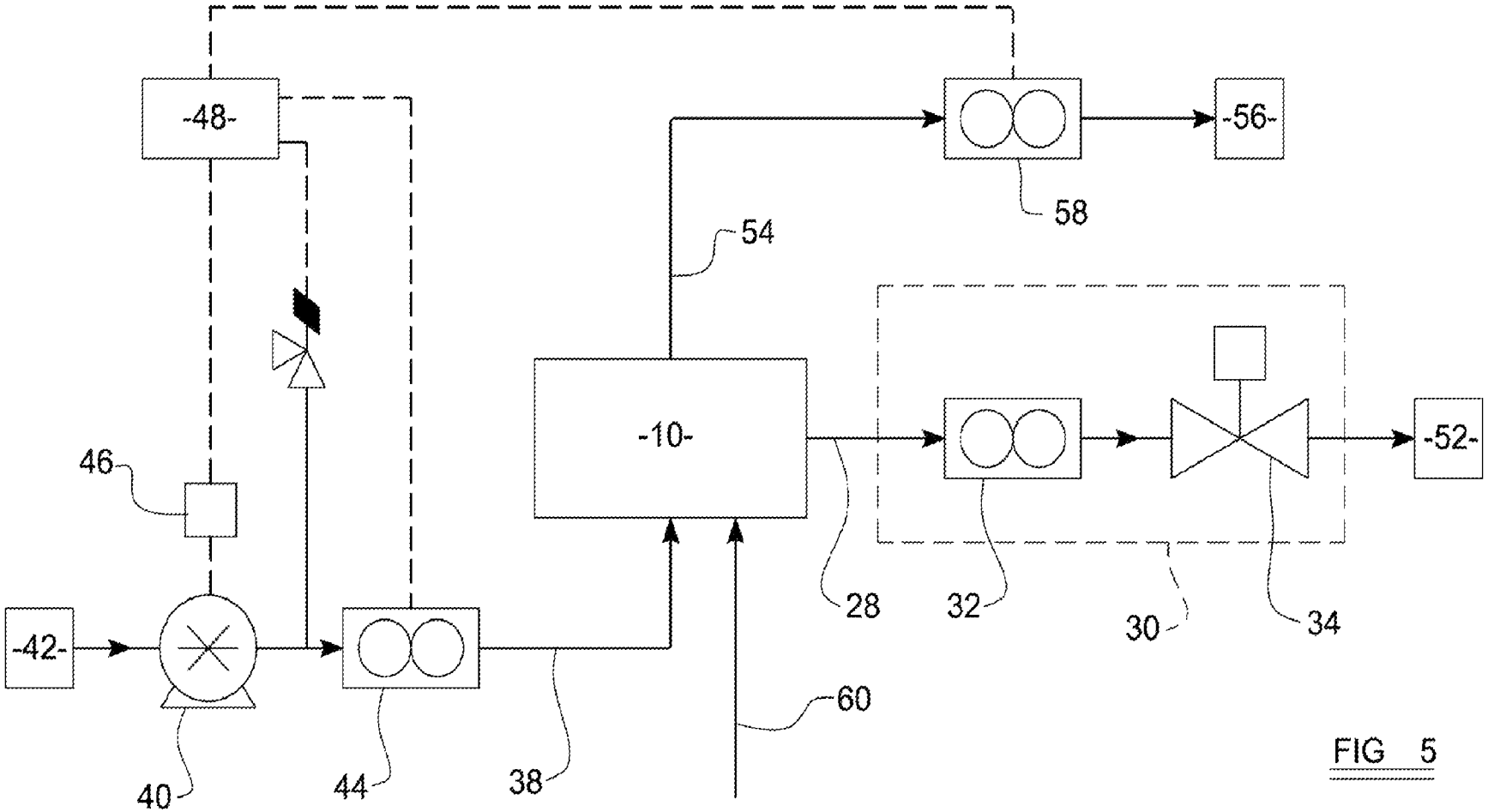
FIG. 5 is a schematic illustration of a drilling system incorporating a pressure containment device according to the present invention.

Referring now to FIG. 5, the housing 12 is provided with a main returns outlet port 26 which extends through the housing 12 into the longitudinal passage 14 of the housing 12 below the lower locking dogs 24. The main returns outlet port 26 is connected to a returns flow line 28 which provides the conduit for the returned drilling fluid to an MPD control manifold 30. In this embodiment, the control manifold 30 comprises a flow meter 32 and pressure control valve PCV 34 as is well known in the art. It should be appreciated, however, that an alternate control manifold can be used for its application with the inventive system. The control manifold 30 directs the returns to drilling fluid treatment systems 52 such as filters, shaker tables, mud-gas separators (MGS) etc.

An injection port 36 extends through the housing 12 into the longitudinal passage 14 of the housing 12 between the lower locking dogs 24 and the main returns outlet port 26. The injection port 36 is connected to an injection flow line 38 which extends from an injection pump 40 which draws from a reservoir of clean drilling fluid 42. It should be appreciated, however, that an alternative low solids content fluid may be used for this application, such as a base fluid for the drilling fluid in use. A further flow meter 44 is provided in the injection line between the pump 40 and the injection port 36.

The pump 40 is fitted with a relief valve 41 to prevent overpressuring of the wellbore or riser. The relief valve 41 may be routed to the MGS or rig fluid treatment systems 52. The pressure setting of the relief valve 41 is programmed by an input into a central processing unit (CPU) 48 of the drilling system, and the setting depends on wellbore and riser pressure limitations. The pump 40 may be remotely operated via a dedicated electronic control unit (ECU) 46 controlled by the central processing unit (CPU) 48.

An overflow outlet port 50 extends through the housing 12 into the longitudinal passage 14 of the housing 12 above the upper locking dogs 22. The overflow outlet port 50 may be connected, via an overflow line 54, to either the rig's drilling fluid treatment systems 52 or a dedicated fluid treatment system 56. In this embodiment a flow meter 58 is provided in the overflow line 54.

The three flow meters 32, 44 and 58 are all electrically connected to the CPU 48, and, in operation, each transmits a data stream representing real time measurements of the flow rate through the flow meter 32, 44, 58. All three flow meters 32, 44 and 58 may be the same type of mass flow meter, but it should be appreciated that different types of flow meter could be used in one of more of these locations in the system.

The drilling system may be operated as described below and with reference to FIG. 5.

Hydraulic fluid pressure is applied to the close chamber of the annular piston 18 and packer 20 assembly of the pressure containment device, so that the piston 18 forces the packer 20 to protrude inwards towards the seal sleeve 10, thus applying radial pressure on the external surface of the seal sleeve 10.

The seal sleeve 10 is forced inwards against the drill string, forming the non-rotating seal on the drill string.

Once the seal is established, the mud circulation required for drilling may be commenced as in conventional drilling systems, by pumping drilling fluid down the drill string and into the well bore. Drilling fluid returns from the wellbore annulus (represented by line 60 in FIG. 5) reach the seal sleeve 10, and are diverted to the returns flow line 28 and through the flow meter 32 and PCV 34. The PCV 34 applies back pressure on the riser and/or wellbore annulus by choking the diverted return flow stream during drilling and circulation. The drilled fluid returns flow from the PCV 34 to the MGS or the rig's fluid treatment system 52 for processing. Mass flow meter 32 monitors the returned flow rate from the well and analyzes any deviation in the returned flow rate from the drill pipe injection rate. The mass flow meter 32 is highly accurate and well known in the art. This is a standard configuration and method for MPD operations.

The inventive method differs from the prior art methods in that the injection pump 40 is also activated to pump clean virgin drilling fluid (or an alternative low solids fluid) into the riser directly below the seal sleeve 10 via the injection port 36. The fluid pressure in the close chamber of the pressure containment device is adjusted to that the seal sleeve 10 closing pressure is decreased to just below the existing annulus pressure being dictated by the PCV 34 in the returns flow line. This deliberately establishes a leak rate across the sealing face of the seal sleeve 10. Some of the injected fluid from the reservoir 42 creates a fluid buffer below the sealing sleeve 10, whilst a further portion of its flow passes along the returns flow line 28 via the flow meter 32 and PCV 34 in the control manifold 30.

The fluid leaking past the seal sleeve 10 flows into the overflow outlet port 50 directly above the upper hydraulic locking dogs 22, along the overflow line 54 and through the flow meter 58. The clean fluid returns to the separate fluid treatment system 56 or to the rig's fluid treatment system 52, depending on how the system is set up.

As mentioned above, the seal sleeve 10 provides a non-rotating seal with the drill string. In other words, the seal sleeve 10 remains stationary whilst the drilling string is rotated during drilling. The fluid leaking past the seal sleeve 10 thus provides lubrication between the seal sleeve 10 and the drill string, reducing the coefficient of friction between the contact faces, and may allow the seal sleeve 10 to act as a hydrodynamic bearing on which the drill string may rotate. The rate of wear of the seal sleeve 10 may therefore be reduced.

The injected fluid also produces a clean fluid buffer between the returned drilling fluid stream 60 from the wellbore and the bottom of the seal sleeve 10, which may reduce or substantially prevent migration of cuttings or any other solid from the returned drilling fluid to the sealing face of the seal sleeve 10. This may further assist in reducing the rate of wear of the seal sleeve 10.

The lubricating fluid injection rate can be increased to substantially prevent gas migration from occurring upwards through the sealing face when gas is present from an influx or as a result of gas breaking out of solution below the seal sleeve 10. This provides an added safety level to the inventive system and method.

The three separate flow meters 32, 44, 58 may be used to monitor, accurately, the flow of fluid throughout the system. The CPU 48 analyzes the continuous data streams from the flow meters 44, 58 in the injection flow line 38 and the overflow line 54, and transmits this data to and MPD processing centre (not shown) where it is used with the data stream from the main returns flow line flow meter 32. Through this continuous analysis sequence, it can be determined if steady state flow/mass balance is present in the overall circulating system. Any deviation from steady state flow is identified by the main MPD processing centre on the rig.

The differences between a prior art MPD system, and a drilling system operated as described above are illustrated schematically in FIGS. 6 and 7.

Figure 6:
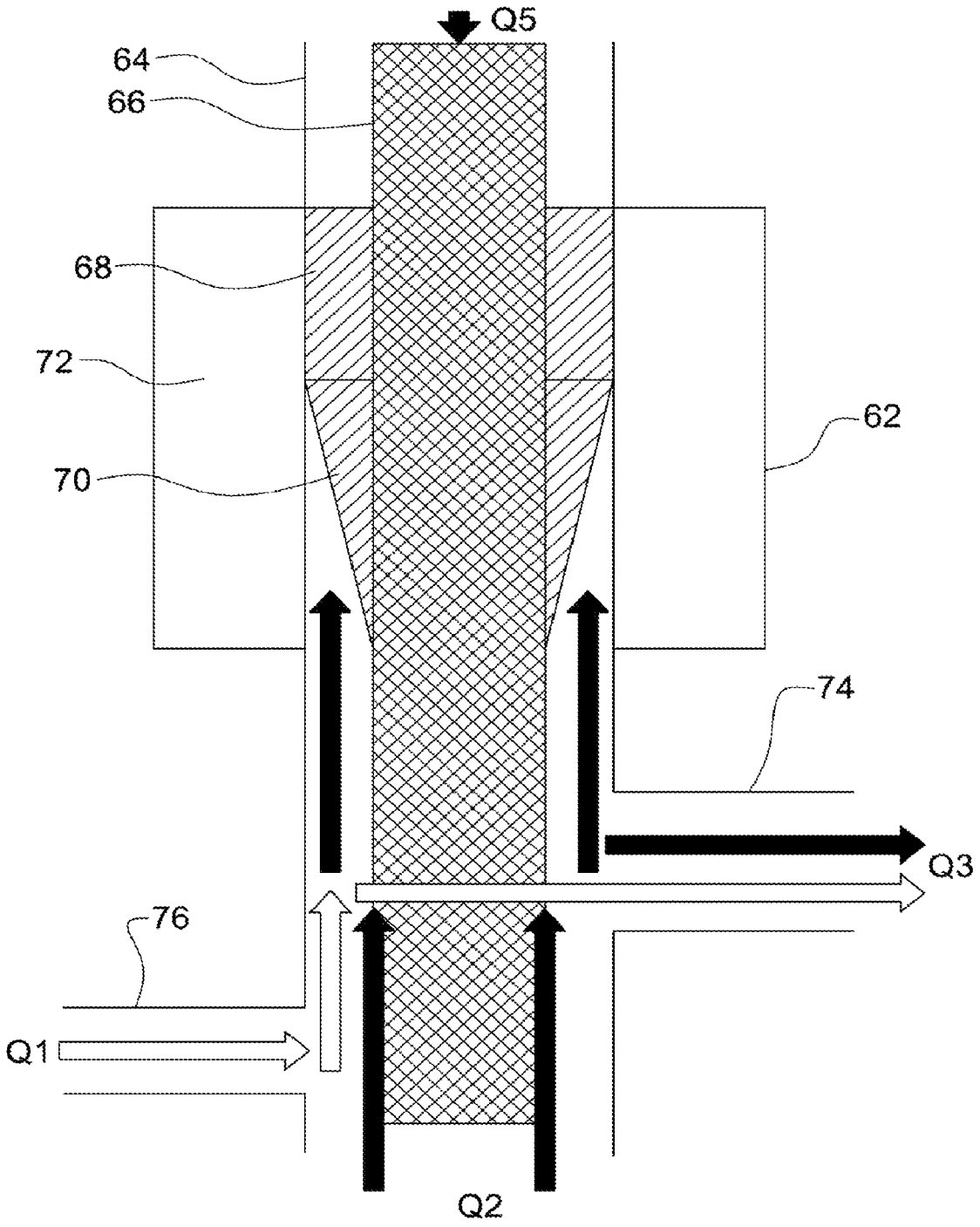
FIG 6 (PRIOR ART)
FIG. 6 is a schematic illustration of fluid flow paths in a drilling system incorporating a prior art pressure containment device.

Referring to FIG. 6, a simple cross section of a typical riser pressure containment (RPC) device from the prior art (such as that disclosed in US2013/0118749, for example) revealing the associated flow paths that are typical with its operation. The RPC device 62 is installed in either an offshore riser system or above a BOP on a land rig. Above the RPC device 62 is situated either a bell nipple or a section of riser pipe 64 depending on its installation location. Drill pipe 66 extends through a rotating bearing assembly 68 and its sealing element 70 seals around the drill pipe 66, with the bearing assembly and sealing element 70 rotating with the drill string during drilling. The bearing assembly 68 is hydraulically latched within a bearing housing 72. For simplicity, in this example, only a single seal is illustrated. It should be appreciated, however, that other types of RPC devices contain dual seal arrangements. Hydraulic fluid pressure is supplied to the bearing housing 72 for lubricating and cooling the bearings, and sustaining the latching force on the bearing assembly 68 while it is in operation.

A returns flow line 74 extends from a port in the riser just below the sealing element 70, whilst an injection flow line 76 extends into a port in the riser below the returns flow line 74.

In FIG. 6, the black arrows represent the flow path of returned drilling fluid, while the white arrows represent the flow path of annular injected drilling fluid.

In normal drilling and circulating mode, the returned drilling fluid flows up the annulus at rate Q2 and should be equal to the drillpipe injection rate Q5 into the well for drilling. All return flow Q2 is diverted to the main returns flow line 74, and the total flow rate exiting the return line is measured as Q3. Surface pressure is applied on the returns flow line 74 via an MPD choke valve (not shown in FIG. 6), which ultimately increases the riser and wellbore pressure.

This forces the returned drilling fluid and drilled cuttings upwards against the sealing element 70 while diverting all pressurized flow through the main return line 74.

In connection mode, and in the absence of continuous circulation methods, the returned drilling fluid rate Q2 from the annulus ceases as the pumping of drilling fluid is stopped and drilling injection rate Q5 drops to zero. Injection of fluid into the riser through the injection flow line 76 commences, at a fluid injection rate Q1. Q1 is increased but synchronized with the decreasing rate of Q5 such that pressure is maintained in the riser and wellbore throughout the connection process as Q5 approaches zero. The pressure is held constant with a combination of the annular injected fluid rate Q1 and the MPD choke valve operation on the main return line 74. The injection point may be the riser booster pump inlet, but it is appreciated another injection point can be used.

During a connection the return flow rate Q3 is monitored, and:

Q3=Q1+Q5 while both pumps are operating.

Q3=Q1 during the connection with the main rig pump off.

Once the connection is complete the annular injection pump rate Q1 decreases as the drilling injection rate Q5 into the drillpipe is increased to maintain a constant pressure in the riser and/or wellbore.

During stripping mode the returned drilling fluid Q2 from the annulus ceases as drillpipe injection Q5 ceases. Annular injection rate Q1 commences at an inlet 6, and is synchronized with the decreasing rate of Q5 such that pressure is maintained in the riser and wellbore while Q5 is at zero. The pressure is held constant with a combination of the annular injection rate Q1 and the MPD choke valve operation on the main return line 7.

This is the only method of fluid injection below conventional prior art RPC devices typically used for MPD operations. At no time is fluid intentionally injected through the sealing face created by the sealing element 70 and the drill pipe 66 for lubrication. When fluid starts to establish a leak rate through the sealing face, this signals the failure of the sealing element 70. Thus the only true indicator that sealing element 70 is failing is fluid or gas leak by. The absence of a means to inject a lubricating fluid across this sealing face to reduce friction allows the friction coefficient to remain high throughout the operational life of the sealing element 70. The results are excessive heat generation and high wear rates. Additionally, there exists no fluid buffer between the returned drilling fluid Q2 and the sealing element 70 in the prior art. Cuttings in the returned drilling fluid may enter the sealing face under pressure as the pipe is stripped or rotated upwards or downwards through the seal, accelerating the wear of the sealing element 3B. Gas breaking out of solution potentially leaks passed the sealing face in absence of a buffer, with the risk of gas leak by increasing as the larger tool joint body passes through the sealing element 70 under these conditions.

Figure 7:
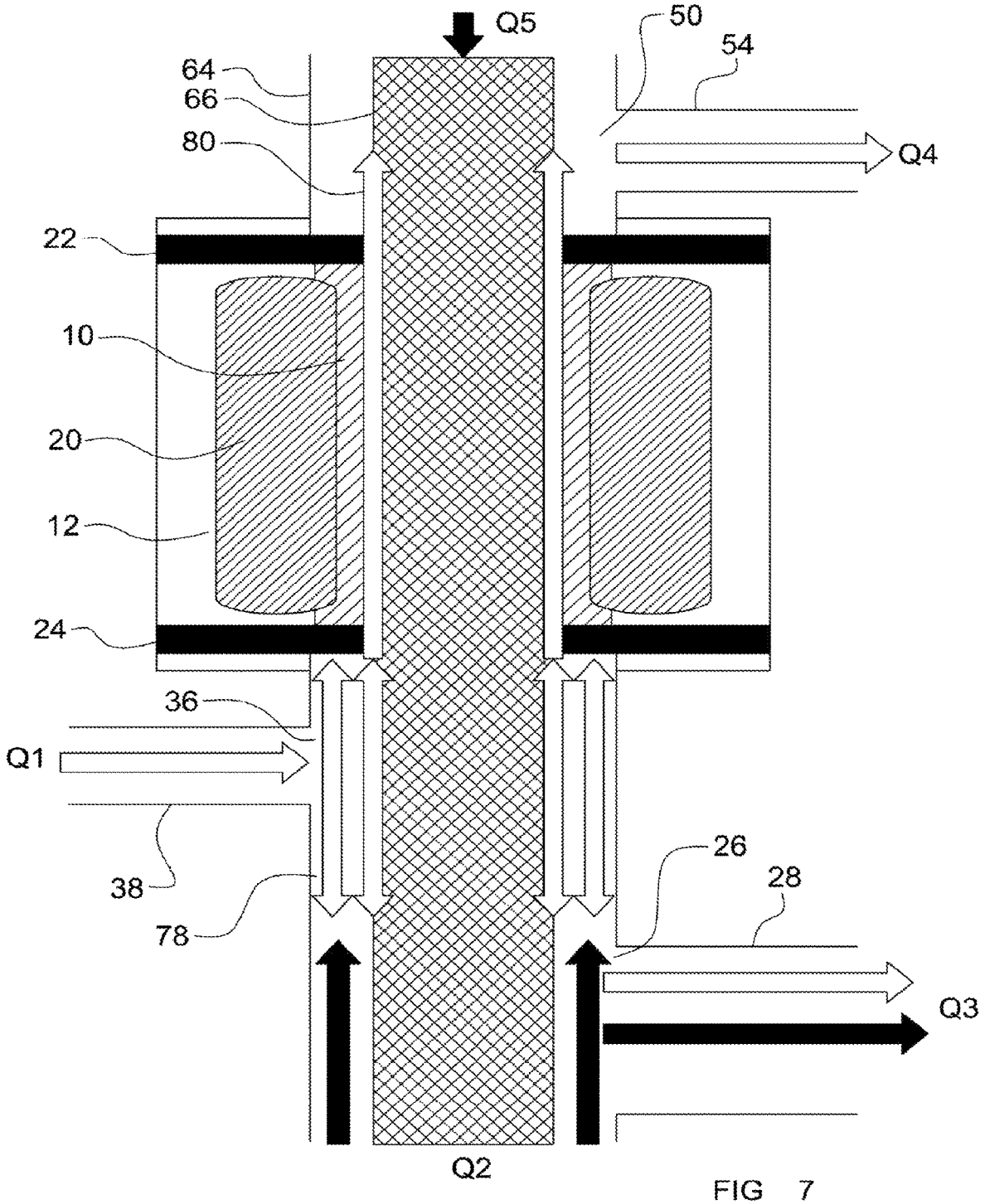
FIG. 7 is a schematic illustration of fluid flow paths in a drilling system incorporating a pressure containment device according to the present invention.

Referring now to FIG. 7, this shows a simple cross section of the pressure containment device described above, and shows the associated flow paths typical to its operation. The pressure containment device is installed in either an offshore riser system or above a BOP on a land rig. The pressure containment device is situated either below a bell nipple or a section of riser pipe 64 depending on its installation location.

In this illustration, the black arrows represent the flow path of the returned drilling fluid, while the white arrows represent the flow path of the injected lubricating (clean drilling) fluid.

For drilling and circulation mode, once the seal sleeve 10 is energized to seal around the drill pipe 66, injection of drilling fluid into the drill string commences at drilling rate Q5, and the returned drilling fluid from the annulus returns at rate Q2. The returned drilling fluid rate from the wellbore is measured through the flow meter (not shown in FIG. 7) on the returns flow line 28 as total return flow rate Q3. The pressure of the wellbore/riser is adjusted during MPD operations using the choke valve (not shown in FIG. 7) on the returns flow line 28. With conventional RPC devices, at steady state conditions in the wellbore during drilling and circulation, Q2=Q5=Q3. However, with the inventive system and method in use, this changes.

Clean drilling fluid is injected through the injection flow line 38 at lubrication injection rate Q1, which creates a fluid buffer 78 between the injection port 26 and the returns flow line 28. Initially, all of the clean fluid enters the returns flow line 28 with the returned drilling fluid Q2, which is measured by the flow meter on the return line 28 as the total return flow rate Q3. The hydraulic closing pressure supplied to the piston of the annular packer 20 is then decreased to intentionally establish a leak rate 80 across the sealing face of the seal sleeve 10. Total return fluid rate Q3 will start to decrease as the leak rate Q4 increases and stabilizes through the flow meter (not shown in FIG. 7) on the overflow line 54. Once Q4 and Q3 are constant drilling can commence, indicating the desired leak rate Q4 has been achieved. Therefore, during drilling with steady state conditions:

$$Q2=Q5$$

The drilling injection rate equals the return rate from the wellbore, and $$Q3=Q2+(Q1-Q4)$$

The total return rate Q3 is now the total return rate from the wellbore plus the difference in the lubrication injection rate Q1 and the leak rate Q4. Any deviation from this relationship would indicate either influx or loss in the well if Q1 and Q4 are not changing.

During connection mode, and in absence of continuous circulation, the returned drilling fluid Q2 from the annulus drops to zero as drilling injection rate Q5 ceases. With the inventive system and method, the closing of the choke is synchronized with the decreasing rate of Q5 such that pressure is maintained in the riser and wellbore throughout the connection while Q5 is at zero. The pressure is held constant with a combination of the lubrication injection rate Q1 and the MPD choke valve position on the main return line 28. During a connection the return flow rate Q3 is monitored, and:

$$Q3=Q1-Q4$$

The total return flow rate Q3 is the difference between the lubrication injection rate Q1 and the leak rate Q4 during the connection period. Any deviation from this relationship would indicate either influx or loss in the well if Q1 and Q4 are not changing.

During stripping mode the returned drilling fluid rate Q2 from the wellbore falls to zero as drill pipe injection Q5 ceases. Lubrication injection rate Q1 continues through the injection ports 8A, 8B and the closing of the choke valve is synchronized with the decreasing rate of Q5, such that pressure is maintained constant in the riser and wellbore while Q5 approaches zero. This maintains wellbore pressure throughout stripping of the drill pipe 66 in and out of the well. The pressure is held constant with a combination of the lubrication injection rate Q1 and the MPD choke valve operation on the main return line 28 while a continuous leak rate Q4 is present during stripping.

$$Q3=Q1-Q4$$

During stripping, the total return fluid rate Q3 is the difference between the lubrication injection rate Q1 and the leak rate Q4. Any deviation from this relationship would indicate either influx or loss in the well if Q1 and Q4 are not changing.

An important aspect of the inventive system and method during stripping is the measured leak rate Q4 assisting the passing of the larger diameter tool joint body through the seal sleeve 4. This greatly reduces the frictional component of the force from the larger tool joint body as it enters the seal sleeve 10, while continuously cooling the sealing interface. Between the lubrication from the fluid 80 leaking across the sealing face of the seal sleeve 10 and the fluid buffer 78 it creates below the sealing point, both the resultant wear and the risk of losing the integrity of the seal are minimized. Maintaining the seal integrity is critical over the duration of stripping operations, where both the frequency of passing tool joints and the velocity of the pipe movement through the seal sleeve are higher when compared to drilling mode. The leak rate Q4 through the sealing face produces a hydrodynamic seal within the sleeve-pipe interface which facilitates effectively sealing around the changes in diameter from a pipe body to a tool joint.

Another important aspect of the inventive system and method is its capability to accurately monitor the integrity of the seal sleeve 10 throughout the entire drilling process. Monitoring the lubrication injection rate Q1, the leak rate Q4, and the total return flow rate Q3 assists in identifying problems with the seal sleeve 10 early before total failure can occur.

The following general relationships govern the seal sleeve 10 integrity so that it can be accurately monitored:

If the leak rate Q4 increases and the total return flow rate Q3 decreases in direct proportion while Q1 and Q5 remain constant, this indicates wear has occurred within the sleeve as a higher leak rate is present.

The magnitude of the increase of the leak rate Q4 is indicative of the severity of the wear within the seal sleeve 10.

If the leak rate Q4 decreases and the total return flow rate Q3 increases in direct proportion while Q1 and Q5 remain constant, this indicates the closing pressure to the pressure containment device may have increased as a lower leak rate is present.

In addition to the main factors that affect the flow rates, described herein, other combinations that could alter flow rates Q1, Q2, Q3, Q4, and Q5 are a result of changes in the lubrication injection pump, drilling rate injection pump, any changes in the choke position, or leaks within the riser or other equipment within the closed loop flow path.

The clean fluid buffer 78 created by the lubricating injection rate Q1 can be used to prevent gas migration from occurring up through the sealing face. When gas breakout from the drilling fluid returns Q2 occurs, or if gas is present in the riser from an influx, the lubricating injection rate Q1 is increased via any high pressure pump to overcome the velocity of the migrating gas. This continuously flushes the annular volume between the lubricating injection point and the returns flow line outlet, forcing encroaching gas away from the seal sleeve 10 and into the returns flow line 28 where the gas is separated from the fluid in the MGS of the rig's fluid treatment systems 52.

It should be appreciated that various modifications may be made to the system described above within the scope of the invention.

For example, in this embodiment the returns outlet port 26 and injection port 36 are both are incorporated into the lower housing part 12*b*. Similarly, the overflow outlet port 50 is incorporated into the upper housing part 12*a*. This need not be the case, however, and the returns outlet port 26, the injection port and the returns outlet port 26, or the overflow port 50 may be provided in a housing part which is separate to the housing 12 of the pressure containment device.

Although the pressure containment device described above includes only a single seal, it should be appreciated that a plurality of seals may be provided.

Whilst a single injection port 36 has been described, it should be appreciated that multiple injection ports may be provided in an array around the housing 12. Similarly, more than one returns outlet port and overflow port may be provided.

Whilst the invention is used in conjunction with the type of pressure containment device described in WO2011/128690 and WO2013/127227, it should be appreciated that the invention could equally be applied to any other type of pressure containment system which can be used to contain fluid pressure in a riser by sealing around a tubular drill string. It could, therefore, be employed with the pressure containment devices illustrated in U.S. Pat. Nos. 7,040,394, 7,380,590, or US 2013-0118749. The invention is preferably, however, used in conjunction with a non-rotating seal (is a seal which does not rotate with the drill string during drilling). It is also preferably used in conjunction with an active, non-rotating seal. For example, the invention is not restricted to use with a pressure containment device comprising a seal sleeve 10, and may be used in conjunction with a conventional annular BOP in which the annular packer seals directly against the drill string.

The required lubricating injection fluid rate can be delivered by any high pressure pump commonly found on land and offshore rigs, and thus the inventive system described above can be used on both land and offshore rigs e.g. the standard positive displacement mud pump that is found on all drilling rigs.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A pressure containment device for containing pressure in an annulus around a tubular body, the pressure containment device comprising:

a housing comprising, a housing axis, a passage extending generally parallel to the housing axis, the passage comprising an upper end, a returns outlet port, an injection port, and an overflow outlet port, wherein, each of the returns outlet port, the injection port, and the overflow outlet port extend through the housing from an exterior of the housing into the passage, and the tubular body passes through the housing so that a portion of the tubular body extends along the passage in the housing; and a seal assembly comprising a seal arranged in the housing to surround and enter into a sealing engagement with the tubular body extending along the passage via a sealing face, wherein, the injection port is arranged between the returns outlet port and a first end of the seal, the upper end of the passage is configured for connection to a bell nipple or to a section of a riser pipe and, in use, a fluid flow is directed to the overflow outlet port by exposure to a pressure provided by a fluid in the bell nipple or by a fluid in the section of the riser pipe, and the overflow outlet port is arranged adjacent to a second end of the seal, the second end of the seal being arranged opposite to the first end of the seal, so that the overflow outlet port is separated from the injection port by the seal, and the overflow outlet port is in fluid communication with the fluid in the bell nipple or with the fluid in the section of the riser pipe.

2. The pressure containment device as recited in claim 1, wherein the seal is a generally tubular sleeve.

3. The pressure containment device as recited in claim 1, wherein the seal is configured to remain substantially stationary in the housing when in the sealing engagement with the tubular body which is moving in the housing.

4. The pressure containment device as recited in claim 1, wherein the seal assembly further comprises an actuator which is operable to urge the seal into the sealing engagement with the tubular body.

5. The pressure containment device as recited in claim 4, wherein, the actuator comprises a piston which is movable generally parallel to the housing axis, and the seal assembly further comprises an annular packer arranged between the piston and the seal so that the piston is movable against the annular packer to force the annular packer to act on the seal and to urge the seal into the sealing engagement with the tubular body extending along the passage in the housing, the seal being located in a circular space enclosed by the annular packer.

6. The pressure containment device as recited in claim 1, wherein the seal assembly comprises a plurality of the seals which are arranged to be spaced along the housing axis.

7. The pressure containment device as recited in claim 1, wherein, the housing further comprises a first housing part, a second housing part, a third housing part and a fourth housing part, the seal is arranged in the first housing part, the returns outlet port is arranged in the second housing part, the injection port is arranged in the third housing part, and the overflow port is provided in the fourth housing part.

8. The pressure containment device as recited in claim 7, wherein the first housing part, the second housing part, the third housing part, and the fourth housing part are integral so that the housing comprises a single housing unit.

9. The pressure containment device as recited in claim 7, wherein one or more of the first housing part, the second housing part, the third housing part, and the fourth housing part is separate but is secured relative to the respective adjacent housing part or parts.

10. The pressure containment device as recited in claim 7, wherein, the first housing part is integral with the fourth housing part, and the second housing part is integral with the third housing part.

11. The pressure containment device as recited in claim 1, further comprising:

at least one locking element configured to at least one of retain the seal in the housing and to release the seal so that the seal can be removed from the housing.

12. The pressure containment device as recited in claim 11, further comprising:

two locking elements or two sets of locking elements which are arranged to be spaced along the housing axis so that the seal is, in use, retained between the two locking elements or the two sets of locking elements.

13. The pressure containment device as recited in claim 11, wherein one of the at least one locking element is arranged between the injection port and the seal.

14. The pressure containment as recited in claim 11, wherein one of the at least one locking element is arranged between the overflow port and the seal.

15. A drilling system comprising:

the pressure containment device as recited in claim 1, wherein the seal assembly further comprises an actuator which is operable to urge the seal into the sealing engagement with the tubular body;

a pump which is connected to the injection port via an injection flow line;

an overflow line which extends from the overflow outlet port, the overflow line comprising a flow meter which is operable to measure a rate of flow of fluid along the overflow line; and a processor, the processor being operable to receive the rate of flow of fluid along the overflow line and being configured to intentionally decrease a closing pressure supplied by the actuator so as to intentionally establish a leak rate across the sealing face of the seal if the rate of flow of fluid along the overflow line is below a predetermined value.

16. The drilling system as recited in claim 15, wherein the injection flow line comprises a flow meter which is operable to measure a rate of flow of fluid along the injection flow line.

17. The drilling system as recited in claim 15, further comprising:

a returns flow line extending from the returns outlet port.

18. The drilling system as recited in claim 17, wherein, the returns flow line comprises a flow meter which is operable to measure a rate of flow of fluid along the returns flow line, and further comprising:

a pressure control valve which is operable to restrict the flow of fluid along the returns flow line to a variable degree.

19. The drilling system as recited in claim 17, further comprising:

a drilling fluid treatment system, wherein, the returns flow line is configured to extend from the returns outlet port to the drilling fluid treatment system.

20. A method of operating a drilling system, the drilling system comprising, a drill string as the tubular body, and the pressure containment device as recited in claim 1 for containing pressure in the annulus around the drill string, wherein, the pressure containment device further comprises an actuator which is operable to urge the seal into engagement with the drill string, the returns outlet port is arranged in the housing below a lowermost end of the seal, the injection port is arranged in the housing between the returns outlet port and the lowermost end of the seal, and the drill string passes through the housing so that a portion of the drill string extends along the passage in the housing, the method comprising:

pumping a drilling fluid into the drill string;

allowing the drilling fluid from the drill string to exit an annular space around the drill string via the returns outlet port arranged in the housing below the lowermost end of the seal;

injecting a further fluid into the passage of the housing via the injection port arranged in the housing between the returns outlet port and the lowermost end of the seal;

setting the seal into a sealing engagement with a portion of the drill string extending along the passage in the housing so that a proportion of the further fluid injected into the passage via the injection port can leak up the passage between the drill string and the seal; and operating the actuator to reduce a sealing force with which the seal is urged into the sealing engagement with the drill string so as to intentionally establish a leak rate of the further fluid injected up the passage between the drill string and the seal.

* * * * *